US007411349B2

(12) United States Patent
Kling et al.

(10) Patent No.: US 7,411,349 B2
(45) Date of Patent: Aug. 12, 2008

(54) UV RADIATOR HAVING A TUBULAR DISCHARGE VESSEL

(75) Inventors: Rainer Kling, Wipperfürth (DE); Markus Roth, Landau (DE); Reinhold Wittkötter, Wipperfürth (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 333 days.

(21) Appl. No.: 10/893,350

(22) Filed: Jul. 19, 2004

(65) Prior Publication Data

US 2005/0029948 A1 Feb. 10, 2005

(30) Foreign Application Priority Data

Aug. 6, 2003 (DE) ..... 103 36 088

(51) Int. Cl.
*H01J 11/00* (2006.01)
*H01J 65/00* (2006.01)

(52) U.S. Cl. ..... 313/607; 313/567; 313/234; 313/238

(58) Field of Classification Search ..... 313/607
See application file for complete search history.

(56) References Cited

U.S. PATENT DOCUMENTS

| | | | | |
|---|---|---|---|---|
| 5,214,344 A | | 5/1993 | Kogelschatz | |
| 5,604,410 A | | 2/1997 | Vollkommer et al. | 313/607 |
| 5,994,823 A | * | 11/1999 | Okamura et al. | 313/25 |
| 6,060,828 A | | 5/2000 | Vollkommer et al. | 313/607 |
| 6,097,155 A | * | 8/2000 | Vollkommer et al. | 313/234 |
| 6,459,203 B1 | * | 10/2002 | Kim | 362/225 |
| 6,686,681 B1 | * | 2/2004 | Allgeier et al. | 313/607 |
| 2003/0094563 A1 | | 5/2003 | Yamamoto | |
| 2003/0178940 A1 | * | 9/2003 | Yoshida et al. | 313/634 |

FOREIGN PATENT DOCUMENTS

| | | | |
|---|---|---|---|
| EP | 433916 A1 | * | 6/1991 |
| EP | 0 458 140 B1 | | 9/1995 |
| EP | 1 059 659 A1 | | 12/2000 |
| EP | 1 111 656 A1 | | 6/2001 |
| JP | 2002-245972 | | 8/2002 |
| WO | WO 01/35442 | | 5/2001 |

OTHER PUBLICATIONS

Abstract, JP 2002-245972 A (2002).

* cited by examiner

*Primary Examiner*—Nimeshkumar D. Patel
*Assistant Examiner*—Natalie K Walford
(74) *Attorney, Agent, or Firm*—Robert F. Clark

(57) ABSTRACT

A UV radiator has an essentially tubular discharge vessel designed to produce dielectric barrier discharges at one end and sealed in a gas-tight manner at both ends, and in each case at least one elongate inner and outer electrode which is oriented parallel to the longitudinal axis of the discharge vessel. If it is imagined that the tubular part of the discharge vessel is split into two equal halves by an imaginary longitudinal section, the at least one inner electrode is arranged on the inside of the first imaginary tube half, and the at least one outer electrode is arranged on the outside of the second imaginary tube half, and essentially diametrically with respect to one another. As a result, and as a result of the shape and number and arrangement of the outer electrode(s), directional radiation characteristics are achieved.

18 Claims, 3 Drawing Sheets

UV RADIATOR HAVING A TUBULAR DISCHARGE VESSEL

TECHNICAL FIELD

The invention is based on a UV radiator having an essentially tubular discharge vessel, which is designed to produce dielectric barrier discharges at one end and is sealed in a gas-tight manner at both ends.

Here, the term UV (ultraviolet) radiator is understood to mean radiators which, during operation, emit electromagnetic radiation having shorter wavelengths than in the visible range of the spectrum (approximately 380 to 770 nm), i.e. radiation having wavelengths below approximately 380 nm. In particular, it also includes radiation having shorter wavelengths than approximately 200 nm, which is also referred to as VUV (vacuum ultraviolet) radiation. UV radiators are thus unsuitable for illumination purposes, such as general-purpose illumination, for example. Instead, they are used in process engineering, in particular for surface purification and activation, photolysis, ozone generation, drinking water purification, metalization, and UV curing.

In particular, the invention also relates to high-power UV radiators, i.e. long radiators, for example having lengths of typically a few 10 cm to approximately 2 m, or even more.

Particularly efficient UV radiators have proved to be those based on dielectric barrier discharge, in particular when they are operated using the pulsed operating method described in U.S. Pat. No. 5,604,410.

The term "dielectric barrier discharge" requires by definition at least one so-called dielectrically impeded electrode. A dielectrically impeded electrode is separated from the interior of the discharge vessel or from the discharge medium by means of a dielectric, for example in which the electrode is arranged on the outside of the wall of the discharge vessel which is typically made of glass or another dielectric. This type of electrode is referred to below as the "outer electrode" for short.

The present invention relates to a UV radiator which has at least one outer electrode of the abovedescribed type. In addition, the UV radiator comprises a tubular discharge vessel which is sealed at both ends and surrounds a discharge medium. The discharge medium used is an ionizable filling which is usually made of a noble gas, for example xenon or a gas mixture with an added buffer gas such as neon or halogen additives, for example chlorine, fluorine etc. At least one electrode, referred to below as the "inner electrode" for short, is arranged within the discharge vessel. This inner electrode is unimpeded, i.e. is in direct contact with the discharge medium. The UV radiator is therefore one which is based on a discharge which is dielectrically impeded at one end.

During operation, a high voltage is applied between the inner and outer electrodes, and, as a result, a gas discharge is produced in the interior of the discharge vessel. Owing to the high radiation efficiency, use is preferably made of the pulsed operating method described in the abovementioned U.S. Pat. No. 5,604,410, in particular unipolar voltage pulses. For the purposes of shock protection, the outer electrode is preferably connected to zero potential with respect to ground ("grounded"). The inner electrode is supplied with negative voltage pulses, i.e. acts as a cathode during each voltage pulse. For further details in this regard, reference is again made to U.S. Pat. No. 5,604,410. During the gas discharge, so-called excimers are formed in the discharge medium. Excimers are excited molecules, for example $Xe_2$*, XeCl*, which emit electromagnetic radiation when they return to the initial state, which is generally unbound or is in any case weakly bound. In the case of $Xe_2$* or XeCl*, the maximum of the molecular band radiation is approximately 172 nm and 308 nm, respectively.

BACKGROUND ART

The specification WO 01/35442 shows a UV radiator having a tubular discharge vessel. Arranged centrally and axially within the discharge vessel is a coiled electrode. Provided on the outside of the discharge vessel are a number of strip-shaped electrodes extending parallel to the tube axis and distributed evenly over the circumference. As a result, the radiator essentially radiates evenly over the entire circumference, i.e. rotationally symmetrically, in a non-directional manner. In order for it to be possible for planar surfaces to be irradiated efficiently, it is necessary to use additional reflectors which deflect as much radiation as possible evenly onto the surface to be irradiated. In order also to be able to produce radiators having lengths of more than 20 cm, a holder, for example an axial supporting tube, is provided for the central inner electrode. However, in the case of very long radiators, in particular longer than approximately 1 m, production is increasingly difficult owing to the increasing risk of the supporting tube breaking. On the other hand, it is necessary to prevent the inner electrode from sagging, since this would have a negative effect on the uniformity of the production of radiation along the entire radiator.

DISCLOSURE OF THE INVENTION

The object of the present invention is to specify a UV radiator having a tubular discharge vessel and having radiation characteristics which are not rotationally symmetrical. Further aspects are the possibility of being able to produce high-power radiators, i.e. long radiators, and of achieving a high radiation efficiency.

This object is achieved by a UV radiator having an essentially tubular discharge vessel, which is designed to produce dielectric barrier discharges at one end and is sealed in a gas-tight manner at both ends, and having in each case at least one elongate inner and outer electrode which is oriented parallel to the longitudinal axis of the discharge vessel, whereby the at least one inner electrode is arranged on the inside of an imaginary first tube half of the tubular part of the discharge vessel, and the at least one outer electrode is arranged on the outside of an imaginary second tube half, which is opposite said first tube half, the two opposing tube halves being defined by an imaginary section, which contains the longitudinal axis of the tubular discharge vessel, through the discharge vessel.

Particularly advantageous refinements are described in the dependent claims.

In other words, it is possible to imagine the tubular part of the discharge vessel being split into two equal halves by an imaginary longitudinal section. The at least one inner electrode is arranged on the inside of the first imaginary tube half. The at least one outer electrode is arranged on the outside of the second imaginary tube half, and, specifically, at least in the case of one inner and one outer electrode, essentially diametrically. Even when it is not always expressly mentioned in the considerations below, it should always be remembered that the splitting of the discharge vessel into two tube halves is not real but is purely imaginary in nature and merely serves the purpose of facilitating a more precise description of the arrangement of the inner and outer electrodes.

The essentially diametrical arrangement of inner and outer electrode firstly has the advantage of high radiation efficiency owing to the large arcing distance, relative to the discharge vessel diameter, for the discharge, as is the teaching of U.S. Pat. No. 5,604,410 which has already been mentioned at the beginning. Secondly, it is now possible to move away from a radiation characteristic which is essentially rotationally symmetrical and move towards a more directional radiation characteristic.

For this purpose, in the simplest case, an either strip-shaped or flat outer electrode is arranged diametrically with respect to the inner electrode on the outside of the second tube half of the discharge vessel. In the latter case, the physical extent of the outer electrode, when viewed in the direction of the circumference of the tubular discharge vessel, extends over approximately the entire corresponding physical extent of the second imaginary tube half of the discharge vessel. In this case, the flat outer electrode may be realized by a coating, for example, or else by a suitably shaped metal part, in which the outside of the second tube half of the discharge vessel is embedded, as it were. The flat design of the outer electrode has the advantage that it can also act at the same time as a reflector for the UV radiation, as a result of which targeted radiation is improved further still. For this purpose, a material having sufficient reflection properties for UV radiation, for example aluminum, must be selected for the outer electrode.

As an alternative to the flat outer electrode, more than one, for example two, three or more strip-shaped outer electrodes may also be used. This makes it possible to come close to the radiation characteristics of a flat outer electrode without having the undesirably high capacitive load owing to the large electrode surface. In this case, although the electrodes are arranged unsymmetrically with respect to the entire circumference of the discharge vessel, they can preferably be arranged symmetrically with respect to a plane, which intersects the imaginary tube half and (when viewed in cross section) represents the vertical central line of the semicircle corresponding to the imaginary tube half. It has also been shown that the radiation efficiency is higher with, for example, two strip-shaped outer electrodes than with one flat outer electrode, for example in the form of an arrangement, in which one half is mirror-coated. In addition, it is also possible to achieve a correspondingly higher radiated power than with only one strip-shaped outer electrode.

For this last-mentioned reason, it may also be advantageous to use more than one inner electrode which are then likewise arranged symmetrically with respect to the plane, which intersects the imaginary tube half and (when viewed in cross section) represents the vertical central line of the semicircle corresponding to the imaginary tube half. If the tube half belonging to the inner electrodes is intended to be used as a radiating surface, i.e. in particular when the other tube half is largely or even completely covered by one or more outer electrodes, the inner electrodes are preferably positioned relatively close to the imaginary sectional plane, but only to an extent such that sufficient clearance remains between them and the next outer electrode. It is thus possible to achieve an electrode-free radiating surface which is as large as possible. However, it is also possible to use the other tube half belonging to the outer electrodes as the preferred radiating surface. To which side preference is given in each individual case depends in the end on the specific arrangement of all of the electrodes.

In contrast to the outer electrodes, no strip-shaped electrodes can be used for the inner electrodes, since said strip-shaped electrodes are typically made of conductive silver tracks or the like. Since, for efficiency reasons, the inner electrode is not covered by an additional dielectric layer and is thus not separated from the discharge medium (discharge which is dielectrically impeded at one end), few solvent residues and similar, volatile constituents of such an electrode track would be blown out during lamp operation and, as a result, enter the discharge medium and impair the production of radiation in an unacceptable manner. Instead, a metal wire or the like which is as pure as possible is used for the inner electrode.

In the case of long radiators, it is generally necessary to fix at least one inner electrode to the inside of the first tube half of the discharge vessel. For this purpose, a holder is preferably used which is fixed to the inside of the first tube half. The holder comprises, for example, depending on the length of the radiator, one or more narrow tube pieces, half-tube pieces or rings, through which the elongate inner electrode is threaded. As a result, the inner electrode is held sufficiently well on the mentioned inside of the discharge vessel even in the case of very long radiators, for example having a length of more than approximately 1 m, without sagging to a significant extent. The inner electrode is, for example, in the form of a rod which can be threaded through the "ear-like" holder particularly easily. As an alternative, the inner electrode is in the form of a coil. This can be slightly more complex to thread through the holder. However, it has the advantage that the numerous partial discharges produced in the pulsed operating method form at exactly defined preferred points between the coil and the usually strip-shaped outer electrodes, and are thus very uniformly distributed. For further details in this regard, reference is made to U.S. Pat. No. 6,060,828, in particular to the description associated with FIGS. 5*a*-5*c*. In any case, the at least one inner electrode is made of metal, preferably tungsten or molybdenum. In this case, a metal wire may also be used which is coated with another metal, for example with platinum. This variant is particularly suitable for halogen-containing discharge media or other corrosive discharge media. In this case, the coil need not necessarily be rotationally symmetrical, i.e. three-dimensional. Instead, it may also be flat, for example as a sinusoidal waveform. The flat variant also assists in achieving the aim of a directional radiation characteristic. However, it is important that the inner electrode is very clean before being built into the discharge vessel, since impurities impair the efficiency of UV production.

The holder is made of a temperature-resistant, dielectric material, preferably glass, quartz glass or ceramic. The holder is preferably made of the same material as the discharge vessel wall. It is then possible for the holder to be fixed to the inside by simply fusing it with the discharge vessel. Alternatively, the holder may also be fixed using glass solder, but this may be problematic with regard to impurities in the discharge medium owing to the solvent of the glass solder paste which is to be removed before the discharge vessel is sealed.

BRIEF DESCRIPTION OF THE DRAWINGS

The invention will be explained in more detail below with reference to exemplary embodiments. In the figures.

BEST MODE FOR CARRYING OUT THE INVENTION

Figure 1A:
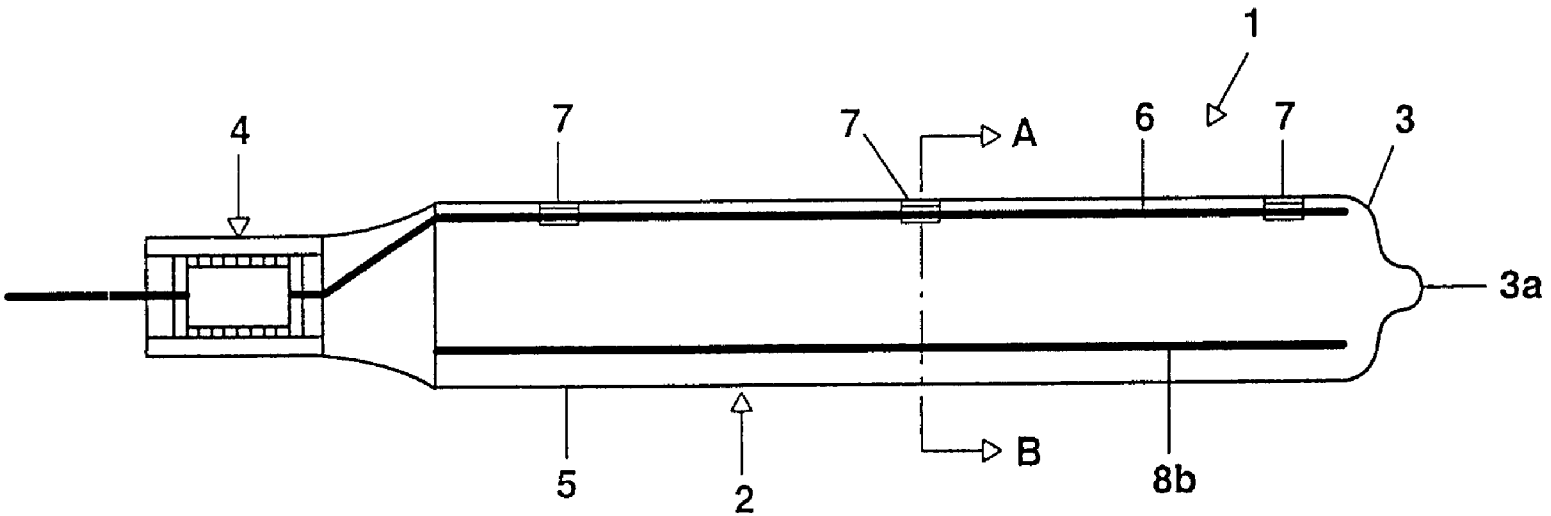
FIG. 1*a* shows a side view of a UV radiator according to the invention having a rod-shaped inner and two strip-shaped outer electrodes.

Reference is made below to the side view of a UV radiator 1, the cross-sectional illustration along line AB and the enlarged detail of the region C, illustrated schematically in FIGS. 1*a*-1*c*, respectively. The UV radiator 1 has an essentially tubular, quartz-glass discharge vessel 2, whose first end is shaped to form a cup-like cap 3 including a sealed-off tip 3*a*, and which is sealed in a gas-tight manner at its other end by means of a pinch seal 4. The discharge vessel 2 is filled with xenon at a pressure of 150 mbar. At a length of approximately 68 cm, the tubular part 5 of the discharge vessel forms the main part of the UV radiator 1 which is designed for an electrical power consumption of approximately 50 W. The total length of the discharge vessel is approximately 72 cm. The inner and the outer diameter of the tubular part 5 is 28 mm and 30 mm, respectively. In FIG. 1*b*, the tubular part 5 is split into two imaginary tube halves 5*a*, 5*b* by an imaginary sectional plane S, which contains the longitudinal axis L. Arranged on the inside of the first tube half 5*a* is an inner electrode 6 comprising a 1 mm-thick molybdenum wire which extends over the entire length of the tube half 5*a* and parallel to the longitudinal axis of the discharge vessel 2. With the aid of three 8 mm-long quartz tube pieces 7 (see FIG. 1*c*), acting as a holder, the rod-shaped inner electrode 6 is fixed to the inside of the first tube half 5*a* such that the clearance with respect to the mentioned imaginary sectional plane S is at a maximum. The quartz tube sections 7 are fused directly to the vessel wall. Their inner diameter is only slightly greater than the diameter of the inner electrode 6, with the result that although the inner electrode 6 can still be threaded through the quartz tube pieces 7 which have already been fixed to the inside of the first tube half 5*a*, it can still be reliably fixed. The inner electrode 6 is passed out in a gas-tight manner through the pinch seal 5. Two strip-shaped outer electrodes 8*a*, 8*b*, made of silver solder and each having a width of 2 mm, are fitted to the outside of the second tube half 5*b*, parallel to the longitudinal axis of the discharge vessel 2. The smallest clearance between the electrodes is 27 mm. With regard to the imaginary sectional plane S, the two outer electrodes 8*a*, 8*b* are positioned symmetrically such that they both have the same clearance from this plane S. During pulsed operation, two discharge planes made up of numerous partial discharges are formed (not shown), specifically one each between the inner electrode and each of the two outer electrodes. For further details on the partial discharges, reference is made to the above-cited U.S. Pat. No. 5,604,410.

Figure 1C:
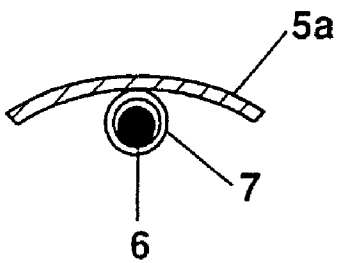
FIG. 1*c* shows an enlarged detail of the region C of the cross section shown in FIG. 1*b*.
Figure 1B:
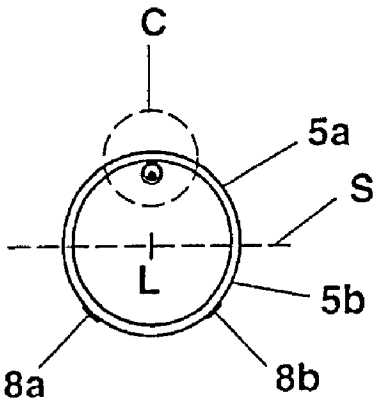
FIG. 1*b* shows a cross section of the UV radiator from FIG. 1*a* along the line AB.

Of course, the invention also makes it possible to build longer radiators than those illustrated in FIG. 1*a*, in which correspondingly more than three retaining points are provided (not shown).

In one variant (not shown), the inner electrode does not comprise a rod-shaped wire but rather a wire coil. For this purpose, the holding parts, for example short tube pieces or rings, are first connected to the vessel wall, and then the wire coil is threaded through the holding parts.

FIGS. 2 to 5 show variants of the UV radiator according to the invention, which differ only in their respective electrode configuration. In this case, identical features are provided with identical reference numerals.

Figure 2:
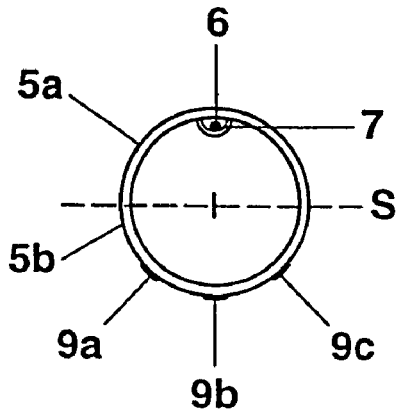
FIG. 2 shows a cross section corresponding to FIG. 1*b* through a variant of the UV radiator according to the invention having three strip-shaped outer electrodes.

FIG. 2 shows a cross section corresponding to FIG. 1*b* through a variant of the UV radiator according to the invention having three strip-shaped outer electrodes 9*a*-9*c*. Owing to the longer arcing distance between the inner electrode 6 and the central outer electrode 9*b*, the central discharge plane (not shown) is formed only when a higher electrical power is injected than is the case for the two other discharge planes, i.e. the discharge planes lying between the inner electrode 6 and the two "external" outer electrodes 9*a* and 9*c*, respectively.

Figure 3:
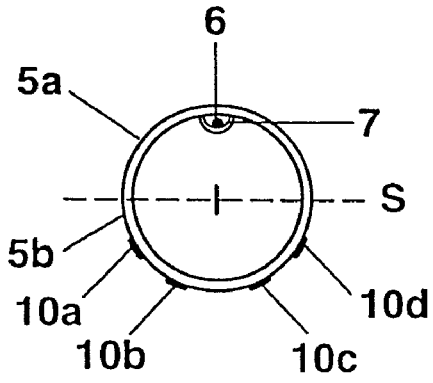
FIG. 3 shows a cross section corresponding to FIG. 1*b* through a variant of the UV radiator according to the invention having four strip-shaped outer electrodes.

FIG. 3 shows a cross section through a variant having four strip-shaped outer electrodes 10*a*-10*d*.

Figure 4:
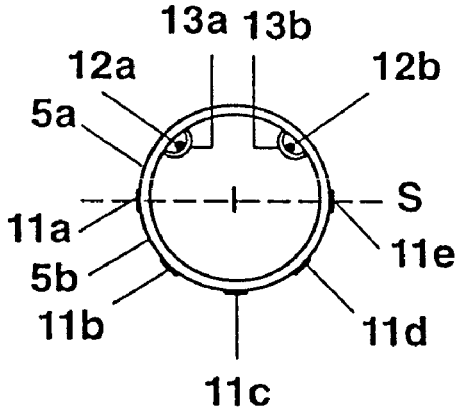
FIG. 4 shows a cross section corresponding to FIG. 1*b* through a variant of the UV radiator according to the invention having five strip-shaped outer electrodes and two rod-shaped inner electrodes.

FIG. 4 shows a cross section corresponding to FIG. 1*b* through a variant of the UV radiator according to the invention having five strip-shaped outer electrodes 11*a*-11*e* and two rod-shaped inner electrodes 12*a*, 12*b*. The two inner electrodes 12*a*, 12*b* are provided for a first pole, and all of the outer electrodes 11*a*-11*e* are provided for a second pole, of the supply voltage. Each of the two inner electrodes 12*a*, 12*b* is fixed to in each case one half-tube piece 13*a*, 13*b* on the inside of the associated tube half 5*a*. As the injected power increases, initially a discharge plane forms in each case between an inner electrode 12*a*, 12*b* and the adjacent outer electrode 11*a*, 11*e*, and then, following this, in each case one further discharge plane is formed between the inner electrode 12*a*, 12*b* and the next outer electrode 11*b*, 11*d* until finally, when the injected power is sufficiently high, all of the discharge planes have formed. The two inner electrodes 13*a*, 13*b* are positioned such that a relatively large electrode-free radiation surface is provided between them.

Figure 5:
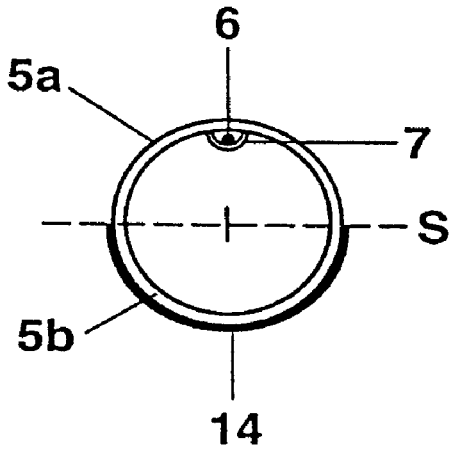
FIG. 5 shows a cross section corresponding to FIG. 1*b* through a variant of the UV radiator according to the invention having a flat outer electrode and a rod-shaped inner electrode.

FIG. 5 shows a cross section corresponding to FIG. 1*b* through a variant of the UV radiator according to the invention having a flat outer electrode 14 and a rod-shaped inner electrode 6 having a holder 7. The outer electrode 14 is made of an aluminum layer which covers the entire outside of the associated tube half 5*b*. During operation, a relatively diffuse discharge forms between the inner electrode 6 and the entire flat outer electrode 14.

Figure 6:
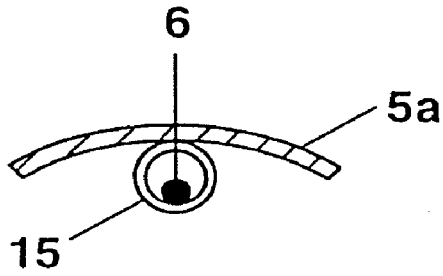
FIG. 6 shows an enlarged detail of the region C corresponding to the cross section shown in FIG. 1*b* of a variant of the UV radiator according to the invention having a modified tubular holder for the inner electrode.

FIG. 6 shows an enlarged detail corresponding to the region C illustrated in FIG. 1*b* of a variant of the UV radiator according to the invention. In this case, the holder for the inner electrode 6 comprises a total of three tube pieces 15 (only one being visible in cross section), whose inner diameter is significantly larger than the diameter of the inner electrode 6 in the form of a wire. As a result, the inner electrode 6 can be threaded more easily through the tube pieces 15 which have been mounted in advance on the inside of the tube half 5*a*. In addition, a larger inner diameter has the advantage that no, or at least fewer, parasitic surface discharges form in the region of the holders.

Figure 7:
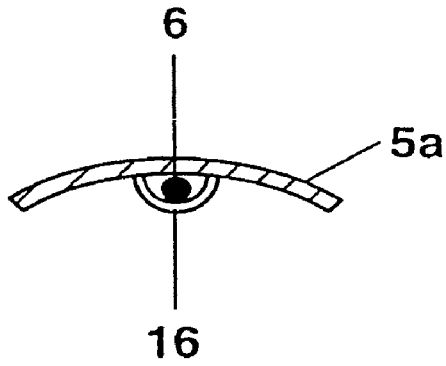
FIG. 7 shows an enlarged detail of the region C corresponding to the cross section shown in FIG. 1*b* of a variant of the UV radiator according to the invention having a holder, in the form of a half-tube, for the inner electrode.

FIG. 7 shows a further variant with the single difference, as compared to FIG. 6, that the holder for the inner electrode 6 is in the form of a half-tube piece 16.

What is claimed is:

1. A UV radiator having an essentially tubular discharge vessel, which is designed to produce a dielectric barrier discharge and is sealed in a gas-tight manner at both ends, and having at least one elongate inner electrode and at least one elongate outer electrode, the inner and outer electrodes being oriented parallel to the longitudinal axis of the discharge vessel and extending the length of the tubular discharge vessel, whereby the at least one inner electrode is arranged on the inside of an imaginary first tube half of the tubular part of the discharge vessel in a holder that is fixed to the inside of the first imaginary half of the discharge vessel, the at least one inner electrode being threaded through the holder and the holder holding the at least one inner electrode so that the at least one inner electrode does not sag to a significant extent, and the at least one outer electrode is arranged on the outside of an imaginary second tube half, which is opposite said first tube half, the two opposing tube halves being defined by an imaginary sectional plane, which contains the longitudinal axis of the tubular discharge vessel.

2. The UV radiator as claimed in claim 1, which comprises precisely one inner electrode and one outer electrode, which are positioned diametrically with respect to one another.

3. The UV radiator as claimed in claim 1, the inner and outer electrodes each being arranged symmetrically with respect to the imaginary sectional plane.

4. The UV radiator as claimed in claim 1, the at least one inner electrode comprising a metallic rod.

5. The UV radiator as claimed in claim 1, the at least one inner electrode comprising a metallic coil.

6. The UV radiator as claimed in claim 1, the at least one inner electrode being coated with platinum.

7. The UV radiator as claimed in claim 4, the metallic rod being comprised of tungsten or molybdenum.

8. The UV radiator as claimed in claim 1, the holder being a tube piece, half-tube piece or ring.

9. The UV radiator as claimed in claim 8, the holder and the discharge vessel wall being made of the same material.

10. The UV radiator as claimed in claim 1, the at least one outer electrode being in the form of a strip.

11. The UV radiator as claimed in claim 1, the at least one outer electrode being flat.

12. The UV radiator as claimed in claim 11, the physical extent of the outer electrode, when viewed in the direction of the circumference of the tubular discharge vessel, extending over approximately the entire corresponding physical extent of the imaginary second tube half.

13. The UV radiator as claimed in claim 11, the at least one outer electrode being in the form of a coating.

14. The UV radiator as claimed in claim 11, the at least one outer electrode being in the form of a solid metal part, in which the outside of the imaginary second tube half of the discharge vessel is embedded.

15. The UV radiator as claimed in claim 1, the discharge vessel being filled with a discharge medium which contains xenon.

16. The UV radiator as claimed in claim 12, the at least one outer electrode being in the form of a coating.

17. The UV radiator as claimed in claim 12, the at least one outer electrode being in the form of a solid metal part, in which the outside of the imaginary second tube half of the discharge vessel is embedded.

18. A UV radiator having an essentially tubular discharge vessel, which is designed to produce a dielectric baffler discharge and is sealed in a gas-tight manner at both ends, and having an elongate inner electrode and two or more elongate outer electrodes, the inner and outer electrodes being oriented parallel to the longitudinal axis of the discharge vessel and extending the length of the tubular discharge vessel, whereby the inner electrode is arranged on the inside of an imaginary first tube half of the tubular part of the discharge vessel in a holder that is fixed to the inside of the first imaginary half of the discharge vessel, the at least one inner electrode being threaded through the holder and the holder holding the at least one inner electrode so that the at least one inner electrode does not sag to a significant extent, and the outer electrodes are arranged on the outside of an imaginary second tube half, which is opposite said first tube half, the two opposing tube halves being defined by an imaginary sectional plane, which contains the longitudinal axis of the tubular discharge vessel, the inner electrode being situated at a maximum clearance with respect to the imaginary sectional plane and the outer electrodes being positioned symmetrically such that they have the same clearance from the imaginary sectional plane.

* * * * *